US006053750A

United States Patent [19]

Waible

[11] Patent Number: 6,053,750

[45] Date of Patent: Apr. 25, 2000

[54] PLUG BRIDGE FOR AN ELECTRIC APPLIANCE PLUG

[75] Inventor: Thomas Waible, Waldbronn, Germany

[73] Assignee: Taller GmbH, Waldbronn, Germany

[21] Appl. No.: 08/928,153

[22] Filed: Sep. 12, 1997

[30] Foreign Application Priority Data

Sep. 20, 1996 [DE] Germany ..... 196 38 510

[51] Int. Cl.[7] ..... H01R 4/66; H01R 13/648

[52] U.S. Cl. ..... 439/106; 439/103; 439/130

[58] Field of Search ..... 439/103, 105, 439/106, 131, 651, 695

[56] References Cited

U.S. PATENT DOCUMENTS

| | | | |
|---|---|---|---|
| 3,739,317 | 6/1973 | Wise | 439/103 |
| 4,201,431 | 5/1980 | McDonald | 439/103 |
| 5,378,162 | 1/1995 | Waible | 439/106 |
| 5,411,403 | 5/1995 | Blanche | 439/106 |

*Primary Examiner*—Paula Bradley
*Assistant Examiner*—Katrina Davis
*Attorney, Agent, or Firm*—Baker & Daniels

[57] ABSTRACT

A plug bridge for an electric appliance plug for connection of electric appliances to an outlet of an alternating current network, wherein the appliance plug is formed as a unit by the plug bridge joined to the end part of the appliance cord and enclosed by injection-molding, which unit consists of a form-stable insulating element for receiving and fixing the current conductor contact pins where the contact pins are integrated in insulating element apertures matching their cross section. The contact pins protrude relative to the plug bridge and the appliance plug sufficiently far for insertion in an electric outlet and are suited for connection, on lugs disposed inside the appliance plug contour and protruding relative to plug bridge plane, to the respective leads of the electric cord. The insulating element includes transverse to the plane of the contact pins a receiving aperture for insertion of an insert element supporting a ground prong.

7 Claims, 2 Drawing Sheets

PLUG BRIDGE FOR AN ELECTRIC APPLIANCE PLUG

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a plug bridge for an electric appliance plug.

2. Description of the Related Art

Plug bridges, or appliance plugs, of this type are known, for example with reference to DE 42 39 261 A1, and may be two-pole plugs with a pair of current conductor pins (hereinafter termed contact pins) or three-pole plugs with a pair of contact pins and a safety or ground pin. The design of the ground pin is such that it leads relative to the contact pins, that is, is of greater length.

Such a two-pole plug bridge is formed as a unit with the plug bridge joined to the end of the appliance cord and enclosed by injection molding. The bridge consists of a form stable insulating element that receives the contact pins, the pins received in apertures in the insulating element that match their cross section. The pins include lugs, or any other suitable connectors, that are disposed within the plug contour and protrude relative to the plane of the bridge to connect to respective leads of the appliance cord.

According to the prior art, the contact bridges for two-pole and three-pole plugs are designed and manufactured separately.

BRIEF SUMMARY OF THE INVENTION

The objective underlying the present invention consists in providing a plug bridge of the general type described above which by its basic configuration serves as a basic element for a two-pole plug, but beyond that is modified such that it can be used also as the basic element for a three-pole plug.

This is accomplished by providing an aperture transverse to the plane defined by the contact pins that receives an insulated insert supporting a ground pin. In other words, the core of the present invention consists in providing a plug bridge whose basic configuration is suited for the manufacture of two-pole appliance plugs and at the same time, by means of a simple modular insert, suited for the manufacture of three-pole appliance plugs.

According to the particular embodiment described and illustrated, the insert and the receiving opening are of a complementary design relative to each other such that a form-fit locking connection is created.

A preferred embodiment of the invention is explained hereinafter with the aid of the drawings, which show in:

DETAILED DESCRIPTION OF THE INVENTION

Figure 1A:
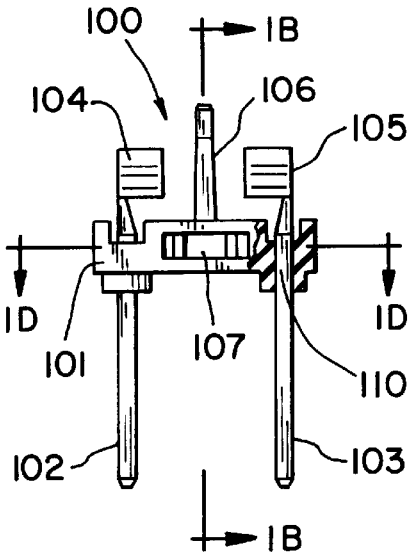
FIG. 1A is a partially sectional view of the plug bridge according to one embodiment of the present invention.
Figure 1B:
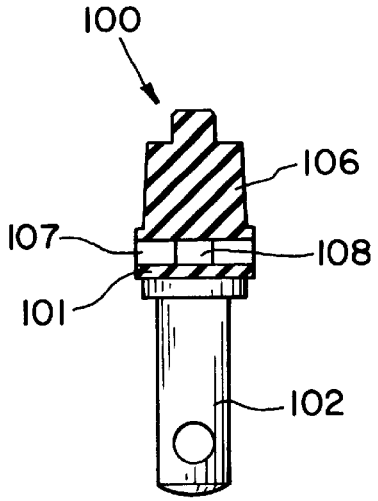
FIG. 1B is a sectional view taken along line 1B—1B of FIG. 1A and viewed in the direction of the arrows.
Figure 1C:
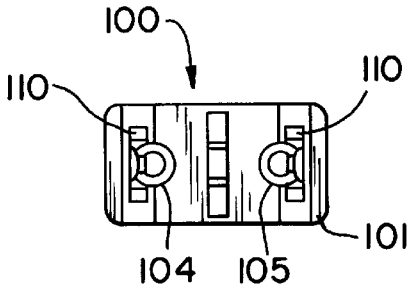
FIG. 1C is a top view of the plug bridge.
Figure 1D:
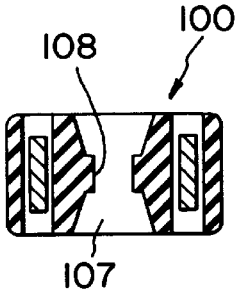
FIG. 1D is a sectional view taken along line 1D—1D of FIG. 1A and viewed in the direction of the arrows.

The two pole plug bridge 100 according to FIG. 1 consists substantially of an insulating element 101 of stable form made of hard-elastic plastic. Its shape, that is, its outer form is a flat plate-like part in the basic shape of a flat cuboid.

According to the exemplary embodiment of FIG. 1, plug bridge 100 comprises two metallic pins 102, 103 inserted in insulating in openings 110 element 101, both serving as the respective current and neutral contact pins when the appliance plug (not shown) molded around plug bridge 100 is inserted in an outlet. According to the illustrated exemplary embodiment, metallic contact pins 102, 103 are rectangular blades protruding on one side of insulating element 101. Blades 102, 103 are on the other side of insulating element 101 shaped such that they are suited for use as lugs 104, 105 for crimped, soldered or brazed leads (not shown) of an electric appliance cord. Basically, as regards the blades, metallic pins 102, 103 can be fixed both via form-fit, pressed in complementary apertures in insulating element 101 and also in conjunction with injection-molding of insulating element 101. Provided in insulating element 101 and on the relevant pin 102 or 103, is a complementary locking connection for both types of joining.

For the sake of completeness, it is noted that a partition 106 is molded to insulating element 101, centered between lugs 104, 105, which partition assures that the any individual wires protruding from the leads of the electric cord will not touch one another.

The configuration described above—both mechanically and geometrically—is known. The present invention relates to the specific design of such two-pole plug bridge 100 wherein it is suited for realizing in a simple manner a three-pole plug bridge 300 (FIG. 3) and forms the basic module for such plug bridge. This is accomplished by providing, transverse to the plane formed by pins 102 and 103, a receiving aperture or passage formed in insulating element 101. Sectional illustrations A—A and B—B in FIG. 1 show how said receiving aperture 107 is configured: namely, as a rectangular through aperture in insulating element 101, with locking noses 108 molded therein which protrude in the center.

Figure 2A:
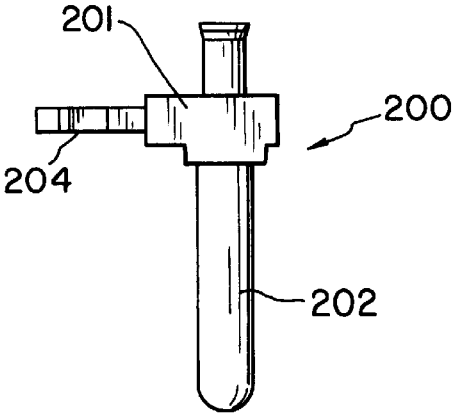
FIG. 2A is a side elevational view of a grounding pin assembly according to one embodiment of the present invention.
Figure 2B:
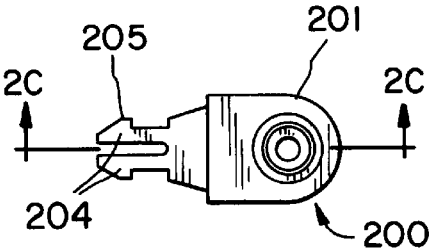
FIG. 2B is a top view of the grounding pin assembly.
Figure 2C:
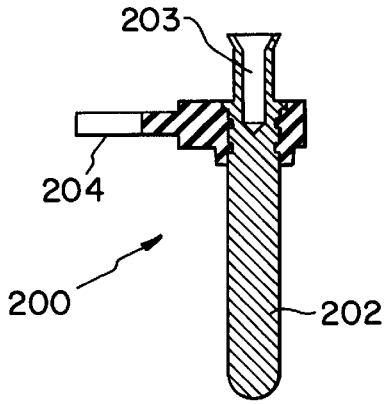
FIG. 2C is a sectional view taken along line 2C—2C of FIG. 2B and viewed in the direction of the arrows.

FIG. 2 shows a grounding pin assembly 200 consisting of an insulating insert 201 and a ground prong formed by a round-section pin 202. Insulating insert 201 has approximately the shape of a flattened bottle (refer to the center view) in which—perpendicularly to the flat side—round section pin 202 is fixedly inserted. The length of round section pin 202, as mentioned previously, is chosen such that it is longer than pins 102, 103 of plug bridge 101. Round-section pin 202 has additionally a bore 203 for insertion of the ground wire of a triplex cord (not shown).

Insulating insert 201 features in the area of the flat bottleneck a split tongue 204, to the end of which locking projections 205 are molded. As the pin assembly 200 according to FIG. 2 now is inserted by way of split tongue 204 in the receiving aperture 107 of plug bridge 100 according to FIG. 1, locking projections 205 snap in place behind locking noses 108 of plug bridge 100 forming a pair of inwardly extending shoulders, with assembly 200 and plug bridge 100 forming a unit, namely a three-pole plug bridge 300 (FIG. 3).

Figure 3B:
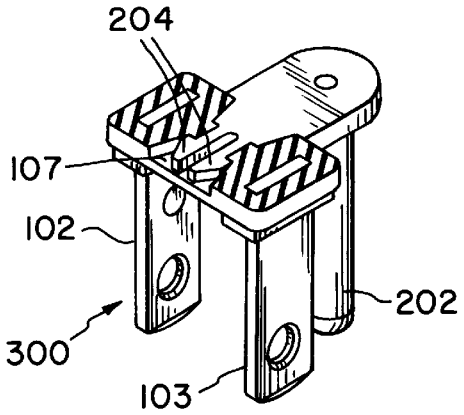
FIG. 3B is a sectional view taken along line 3B—3B of FIG. 3A and viewed in direction of the arrows.
Figure 3A:
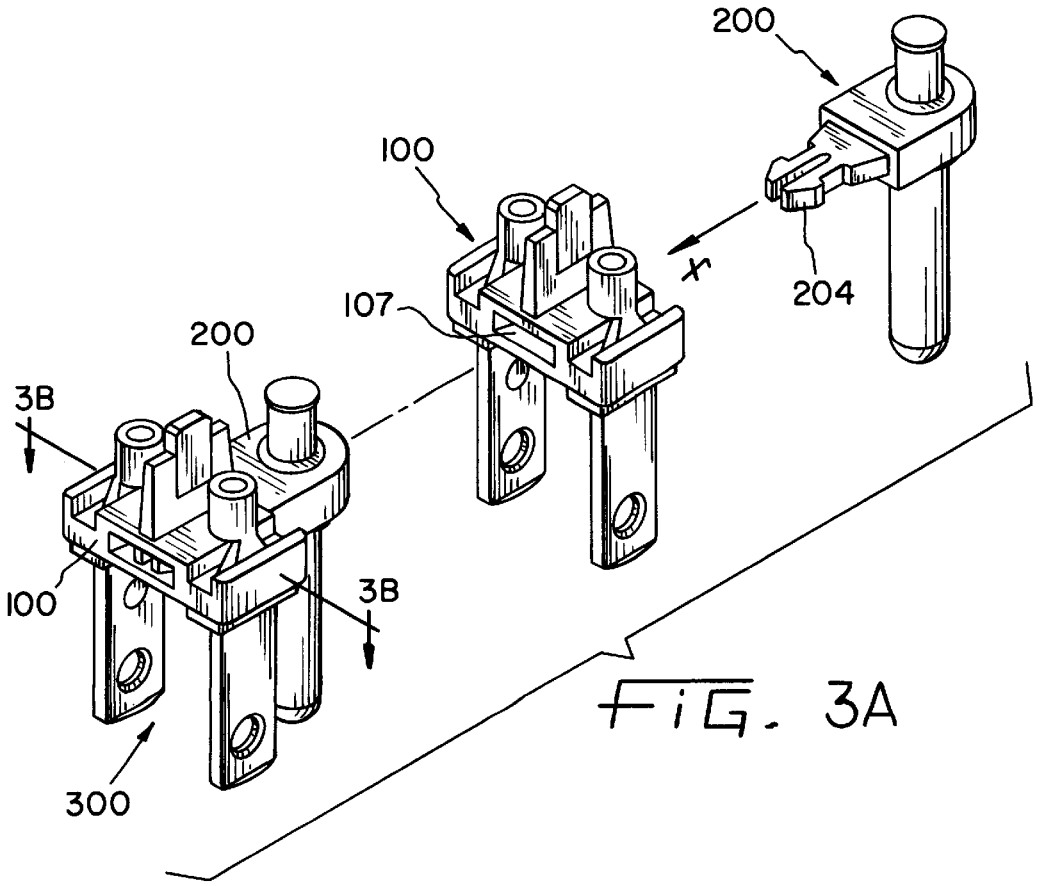
FIG. 3A is a combined exploded and assembled view of the three-pole plug bridge assembly in accordance with one embodiment of the present invention.

FIG. 3 shows assembly 200 inserted in the direction of arrow X with its split tongue 204 in the complementary receiving aperture 107 of the two-pole insulating element 100. Locking projections 205 of tongue 204 snap in place behind locking noses 108 of receiving aperture 107 (refer to section D—D), creating a positive joint between form part 200 and insulating element 100 and thereby forming a three-pole plug bridge 300 with contact pins 102, 103 and grounding prong 202 (left illustration in FIG. 3).

I claim:

1. A plug bridge for an electric appliance plug, the plug formed as a unit by the plug bridge and enclosed by an injection molded part, the plug bridge comprising:

a form-stable insulating element;

a pair of current conductive contact pins received in openings in said insulating element and protruding from one side of said insulating element, said pins being conductively connected to connector elements that are adapted to connect to leads of an electric appliance cord; and said insulating element including an aperture therein having its axis extending transverse to a plane defined by said pair of contact pins, said aperture adapted to receive and support therein an insert element supporting a conductive ground pin;

said insert element including a protruding portion thereon having at least one locking projection extending transverse to said axis of said aperture, said protruding portion being received in said aperture along said axis of said aperture, said aperture having at least one shoulder extending transverse to said axis of said aperture, said locking projection disposed behind said shoulder, said locking projection transversely engaging said shoulder, whereby said protruding portion is positively locked in said aperture along said axis.

2. The plug bridge of claim 1 wherein said insert element is made of electrically insulating material.

3. The plug bridge of claim 1 wherein said connector elements on said contact pins are lugs.

4. The plug bridge of claim 1 wherein said aperture and said protruding portion of said insert element have complementary shapes whereby a positive locking connection is created when said protruding portion is inserted into said aperture.

5. The plug bridge of claim 1 wherein said protruding portion has at least two said locking projections extending transverse relative to said axis of said aperture, said protruding portion being received along said axis of said aperture, said aperture having at least two said shoulders extending transverse to said axis of said aperture, said locking projections engaging said shoulders, whereby said protruding portion is positively locked in said aperture along said axis.

6. The plug bridge of claim 1 wherein said aperture and said protruding portion of said insert element have complementary shapes whereby a positive locking connection is created when said protruding portion is inserted into said aperture.

7. The plug bridge of claim 1 wherein said connector elements on said contact pins are lugs.

* * * * *